US005409232A

United States Patent [19]

Hoganson

[11] Patent Number: 5,409,232

[45] Date of Patent: Apr. 25, 1995

[54] GOLFER'S HEAD MOVEMENT MONITOR DEVICE AND METHOD

[76] Inventor: Eugene M. Hoganson, 2085 Seven Lakes South, West End, N.C. 27376-9611

[21] Appl. No.: 213,740

[22] Filed: Mar. 16, 1994

Related U.S. Application Data

[60] Division of Ser. No. 63,718, May 20, 1993, Pat. No. 5,330,191, which is a continuation-in-part of Ser. No. 946,107, Sep. 17, 1992, abandoned.

[51] Int. Cl.[6] ..... A63B 69/36

[52] U.S. Cl. ..... 273/187.6

[58] Field of Search ..... 273/187.1, 187.6, 190 R, 273/186.3; 362/257

[56] References Cited

U.S. PATENT DOCUMENTS

| | | | |
|---|---|---|---|
| 3,992,011 | 11/1976 | Jessee | 273/187.1 |
| 4,000,904 | 1/1977 | Poortman | 273/187.1 |
| 4,131,280 | 12/1978 | Poortman | 273/187.1 X |
| 4,342,456 | 8/1982 | Miyamae | 273/186.3 X |
| 4,963,314 | 10/1990 | Gering et al. | 273/187.6 X |
| 5,042,814 | 8/1991 | Bennett | 273/187.1 |
| 5,207,429 | 5/1993 | Walmsley et al. | 273/186.3 |
| 5,330,191 | 7/1994 | Hoganson | 273/187.1 |

*Primary Examiner*—George J. Marlo

[57] ABSTRACT

A golfer's head movement monitor device and method for generating two separate narrow beams of light in the general area of a golf ball so that when the golfer has taken his stance to hit the golf ball forwardly in a given direction and his eyes are focused on the golf ball, the beams of light will be seen in his peripheral vision. The device includes a first pair of spaced plates for generating one of said light beams and a second pair of spaced plates for generating a second one of said light beams, said light beams being disposed at an angle to one another, and means for adjusting the space between each pair of spaced plates to adjust the width of the light beam generated between each pair of plates.

9 Claims, 4 Drawing Sheets

GOLFER'S HEAD MOVEMENT MONITOR DEVICE AND METHOD

CROSS-REFERENCE TO RELATED APPLICATION

This is a division of application Ser. No. 08/063,718 filed May 20, 1993, now U.S. Pat. No. 5,330,191, which in turn is a Continuation-in-Part application Ser. No. 07/946,107, filed Sep. 17, 1992, now abandoned.

BACKGROUND OF THE INVENTION

The present invention relates to a golfer's head movement monitor device to be used when practicing a normal golf swing.

One of the most important features of a good golf swing is to minimize movement of the head so as to ensure solid contact with a golf ball to obtain optimum distance and direction. Excessive head movement is probably the most common error occurring with non-expert golfers. This movement may be lateral movement of the head in a direction that is generally parallel with the intended line of flight of the golf ball. The movement may also be from front to back relative to the golfer's body, or it may be in an up and down direction. Since there are several possible types of movement of the golfer's head, it is difficult to monitor.

Many different devices have been proposed in the prior art for monitoring a golfers head movement. For example, U.S. Pat. No. 1,677,261 discloses a sheet of opaque material supported above a golf ball and having a slot therein through which the golfer views a golf ball while swinging. This device will indicated lateral movement of the head, but it will not indicated front and back or up and down movement.

U.S. Pat. No. 3,992,011 discloses a hollow tee through which light shines. The golfer takes his stance and initially observes the light beam. A ball is then placed on the tee and the golfer swings to knock the ball off of the tee. After the swing is completed, the golfer re-observes the light to check and see if he has held his head still. This device provides information as to head position only after the golf ball has been struck, and it may be difficult to determine just what type of movement has taken place.

Accordingly, it is a principal objective of the invention to provide a device which will monitor head movement throughout a golf swing and which will readily identify the type of head movement which is occurring.

SUMMARY OF THE INVENTION

A first form of the invention provides a golf ball support means for supporting a golf ball in position to be hit forwardly in a given direction. Two separate narrow light beams are generated rearwardly of the golf ball support means in such a manner that they are visible to a golfer when he has taken his stance to hit a golf ball on the support means. A first light beam is disposed rearwardly of the support means and extends substantially perpendicular to the given direction of the flight of the golf ball, and the second light beam is generally aligned with said given direction, the second light beam being disposed rearwardly of the first light beam.

These two light beams will be continuously visible to a golfer as long as he moves his head only within a certain range of movement. If he loses sight of either light beam at any point in the golf swing before contact with the golf ball, he knows that he has moved his head too much. The width of the light beams can be made wider for less skilled golfers and narrower for more skilled golfers.

If the golfer loses sight of the first light beam, he knows that he has moved his head too far in a lateral direction. If he losss sight of the second light beam, he knows that he has moved his head excessively in a direction from front to back or up and down.

Means is provided to adjust the angle of the beams with respect to the ground to accommodate golfers of different height. When properly adjusted, the second-light beam will appear to coincide with the intended direction of flight of the golf ball when the golfer takes his stance to hit the ball.

The first form of the invention is enclosed within a housing adapted to be embedded in the ground so that the feet of the golfer are at the same level as the top of the housing. This form of the invention is particularly useful at a driving range where the device can be permanently mounted in position. The device is weatherproof and can be used by either right or left handed golfers.

However, it is also desirable to provide a device which is portable so that it can be taken to any desired location and then readily set up for practice. With such a portable device, a golfer may practice his golf swing at any suitable location, including a conventional driving range.

A second form of the invention is of simpler lightweight construction so that it can be easily carried from one location to another, but at the same time is of rugged, weatherproof construction. This form of the invention may also be used by either right or left handed golfers.

The second form of the invention is adapted to rest on the surface of the ground, and is adapted to be disposed at the far side of a golf ball to be hit relative to the position of the golfer. This form of the invention also provides two separate narrow light beams which extend substantially perpendicular to one another. However, in the second form of the invention, a first light beam extends substantially perpendicular to the given direction of the flight of the golf ball, and the second light beam extends substantially parallel with said given direction, the second light beam being disposed rearwardly of the first light beam.

In the second form of the invention, the device is disposed in the general area of a golf ball so that when the golfer has taken his stance to hit the golf ball with his eyes focused on the golf ball, the beams of light will be seen in his peripheral vision. The angle of the beams may be adjusted to accommodate golfers of different height go that the second light beam will appear to be parallel with the intended direction of flight of the golf ball.

The use of the second form of the invention is similar to that of the first form of the invention, since the two light beams will be continuously visible as long as the golfer moves his head only within a certain range of movement. If he loses sight of either beam he will be aware that he has moved his head too much in a certain manner.

DESCRIPTION OF THE PREFERRED EMBODIMENT

Figure 1:
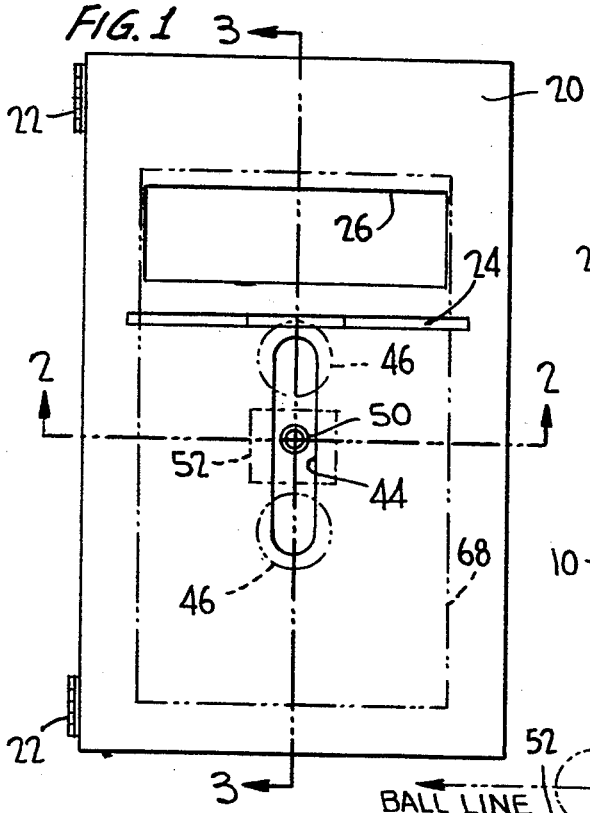
FIG. 1 is a a top view of the outer housing of a first form of the invention.

Referring now to the drawings wherein like reference characters designate corresponding parts throughout the several views, there is shown in FIGS. 1–4 the housing and golf ball support means of the first form of the invention. The housing is preferably formed of steel and is of rectangular shape including opposite parallel side walls 10 and 12 which are connected to opposite parallel end walls 14 and 16. It should be understood that this housing is adapted to be supported by a suitable base embedded the ground so that the feet of the golfer are at the same level as the top of the cover 20 of the housing.

Cover 20 is preferably formed of hardwood and is pivotally connected to the housing by a pair of conventional steel hinges 22. The cover is provided with a first transversely extending narrow slot 24 formed therethrough; and a second transversely extending slot 26 of greater width is also formed therethrough. These slots allow beams of light to pass through the cover to be viewed by a golfer. The slots may be provided with transparent material such as PLEXIGLAS (not shown) to prevent water or dirt and the like from falling through the cover onto the light beam generating means hereinafter described.

A pair of steel angle members 30 and 32 are secured as by welding to the upper portions of the inner surfaces of side walls 10 and 12. A plurality of steel angle members 34, 36, 38 and 40 have the opposite ends thereof secured as by welding to the inner surfaces of side walls 10 and 12. These angle members add rigidity to the housing and support the cover and the components mounted on the cover.

A longitudinally extending slot 44 is formed through cover 20 and is adapted to receive the adjustable support means for a golf ball indicated by phantom line 46. The support means includes a tubular flexible tee 50 which may be formed of rubber. A square steel plate 52 has a hole formed through the center thereof which receives a flat head wood screw 54 which is threaded into a wooden dowel pin 56 which fits within and supports tee 50. It is evident that the tee may be readily removed from the dowel pin and a new tee mounted in operative position when desired.

A steel plate 60 is secured as by welding to the upper surfaces of angle members 38 and 40 and has a hole 62 formed therethrough to gain access to screw 54 in the event that the dowel pin needs to be replaced. Narrow steel spacer members 64 and 66 are secured as by welding to the upper surface of plate 60. It is apparent that members 60, 64 and 66 cooperate to form a guide track for steel plate 52 so that the position of the tee can be adjusted as required according to the size and stance of any particular golfer. The opposite limits of adjustment of the position of the golf ball are indicated in phantom lines 46 in FIG. 1.

Figure 2:
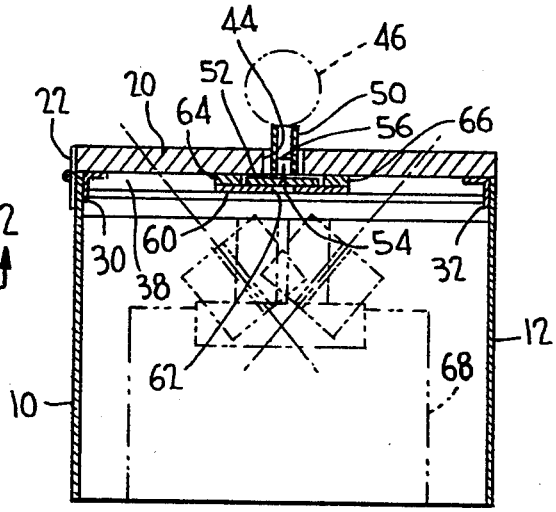
FIG. 2 is a sectional view taken along line 2—2 of FIG. 1.
Figure 3:
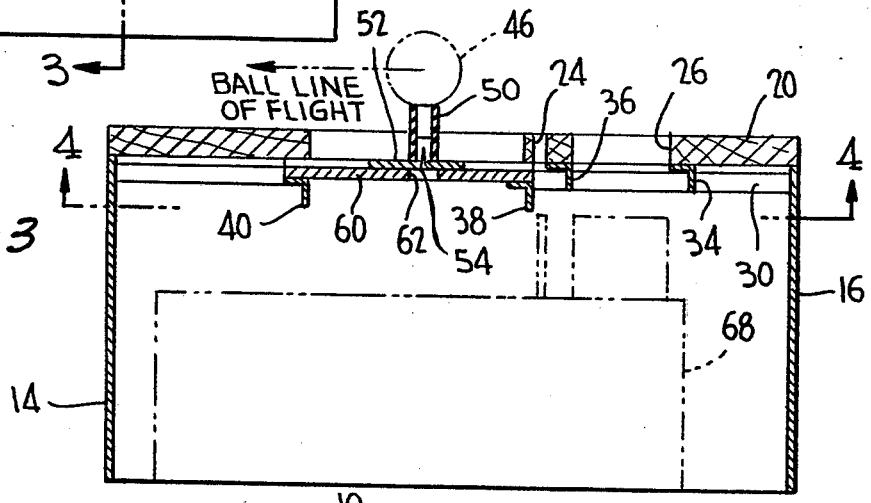
FIG. 3 is a sectional view taken along line 3—3 of FIG. 1.
Figure 4:
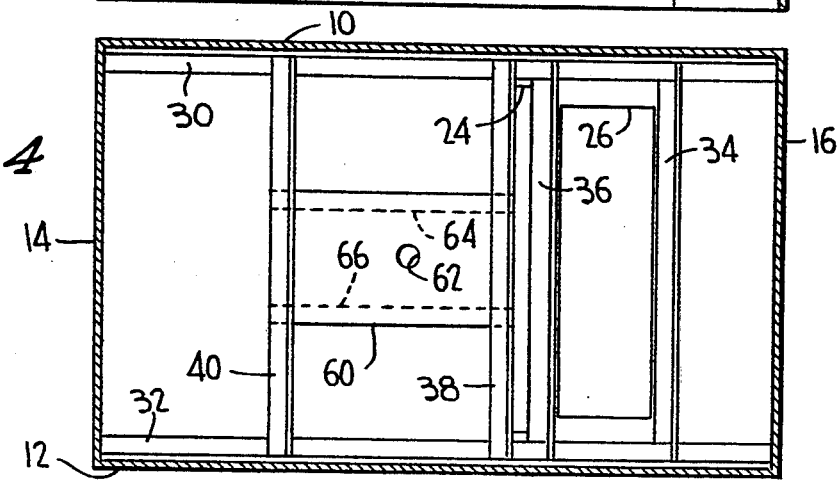
FIG. 4 is a sectional view taken along line 4—4 of FIG. 3.
Figure 5:
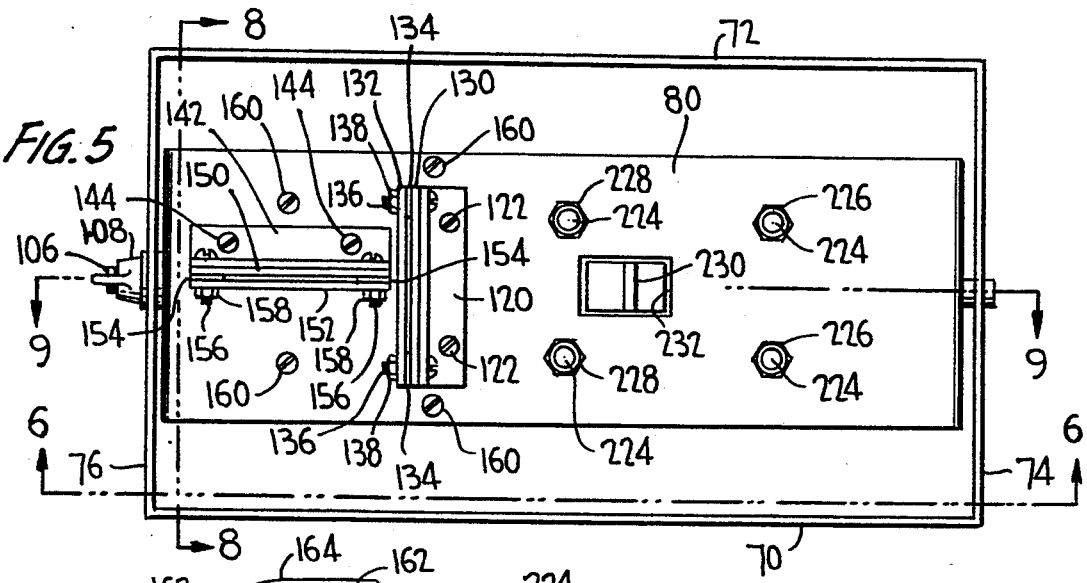
FIG. 5 is a top view of the light beam generating means subassembly of the first form of the invention.
Figure 7:
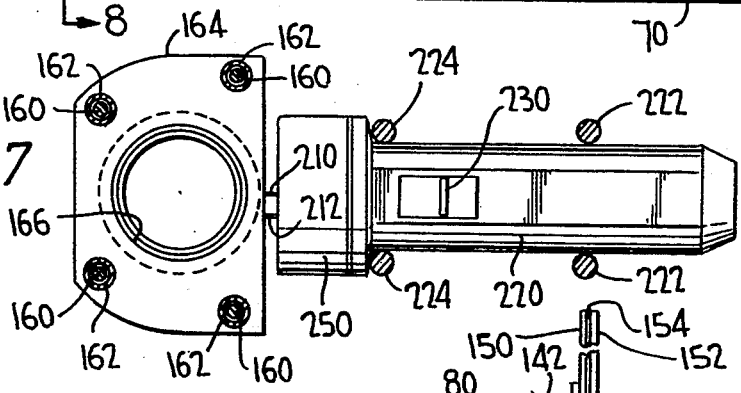
FIG. 7 is a sectional view taken along line 7—7 of FIG. 6.
Figure 8:
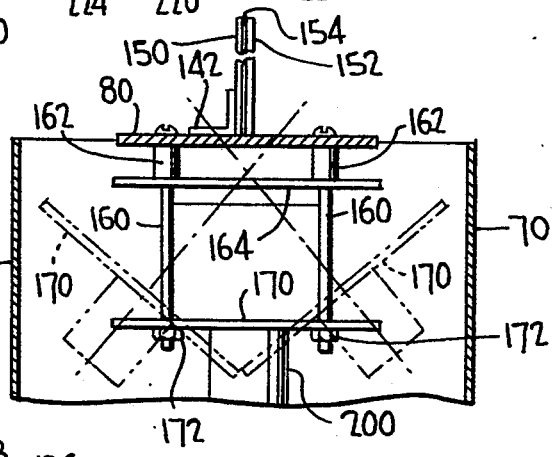
FIG. 8 is a sectional view taken along line 8—8 of FIG. 5.
Figure 6:
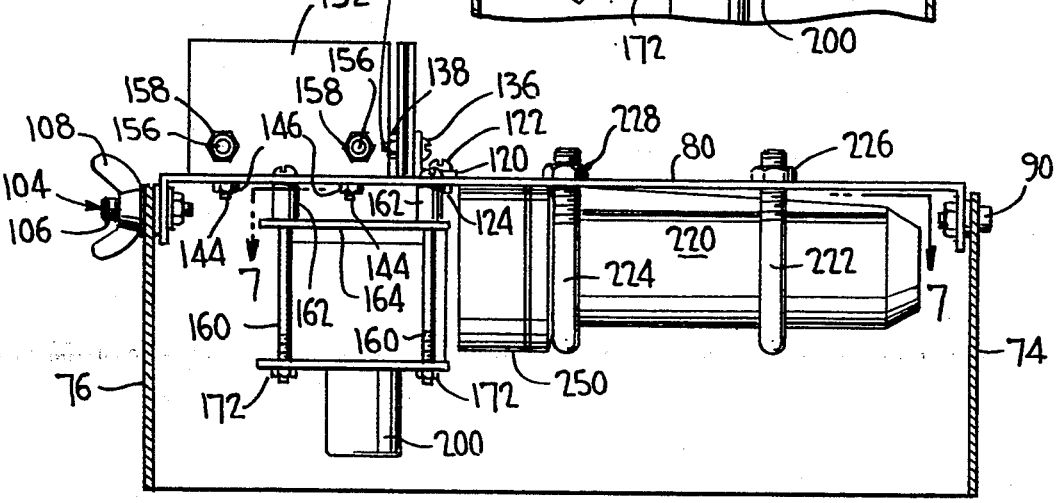
FIG. 6 is a sectional view taken along line 6—6 of FIG. 5.
Figure 9:
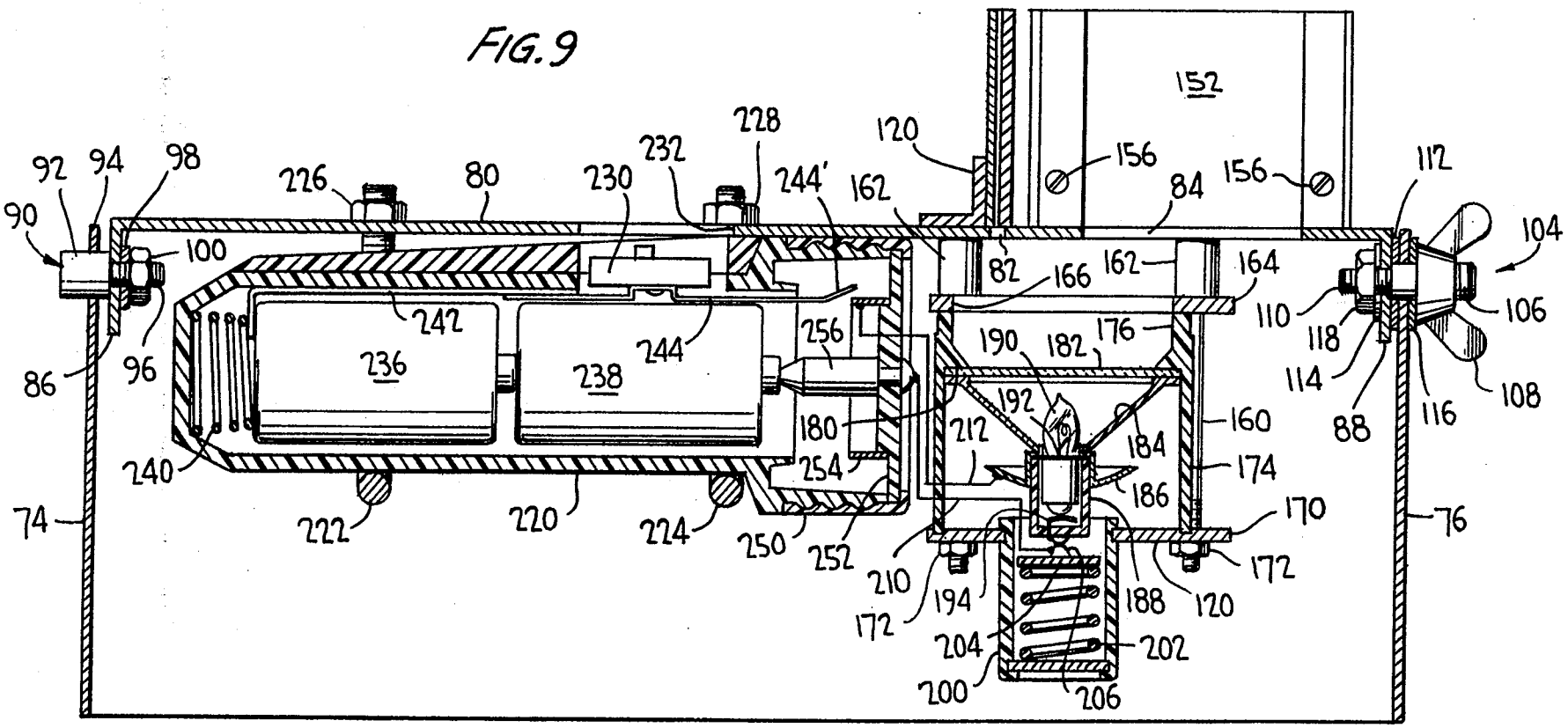
FIG. 9 is an enlarged sectional view taken along line 9—9 of FIG. 5 with the U-bolts removed for the sake of clarity.

The outline of the light beam generating means subassembly is indicated in phantom lines 68 in FIGS. 1–3. It is noted that the housing is placed over and centered with respect to the subassembly so that there is maximum clearance between the housing and the light generating means. This serves to insulate the light generating means from any shock forces which may occur when a golf club strikes the cover of the housing.

Referring now to FIGS. 5–9, the light beam generating means includes a subassembly housing having a pair of spaced parallel side walls 70 and 72 connected to spaced parallel end walls 74 and 76. These walls may be formed of steel and may be connected together as by welding. A mounting means in the form of a steel mounting plate 80 has a transversely extending slot 82 formed therethrough and a longitudinally extending slot 84 formed therethrough. Light is adapted to pass through these slots in an upward direction from a light source beneath the mounting plate as hereinafter described.

Opposite ends of mounting plate 80 are provided with depending portions 86, and 88 for supporting the mounting plate rotatably the subassembly housing. A stud 90 is provided with an enlarged head 92 rotatably disposed within a hole formed in wall 74 of the subassembly housing below the upper edge 94 thereof. The threaded shank 96 of the stud passes through a hole formed in depending portion 86. A lock washer 98 is disposed around shank 96 and a steel nut 100 is threaded on the shank.

At the opposite end of the mounting plate, a stud 104 is provided with an enlarged head 106 having a NYLON wing nut 108 connected thereto. The enlarged head passes through a hole formed in wall 76, and the threaded shank 110 of the stud passes through a hole formed in depending portion 88 of the mounting plate. A plain washer 112 and a pair of lock washers 114 and 116 are provided in surrounding relation to the stud. A steel nut 118 is threaded on shank 110. It is apparent that when it is desired to adjust the angularity of mounting plate 80, the wing nut can be unthreaded to loosen the connection between depending portion 88 of the mounting plate and wall 76. The mounting plate can then be rotated about the axis of aligned studs 90 and 104 to the desired position, whereupon the wing nut can be tightened to hold the mounting plate in the desired adjusted position. It is noted that the mounting plate is rotatably supported about an axis which extends substantially parallel with the intended direction of the line of flight of a golf ball supported by the device.

An angle member 120 is secured to mounting plate 80 by a pair of machine screws 122 extending through aligned holes formed in the angle member and the mounting plate, hex nuts 124 being threaded on the threaded shanks of the screws to hold the angle member in place. A pair of spaced steel plates 130 and 132 have a pair of narrow shims disposed 134 therebetween along the facing vertical edges thereof. The size or number of shims may be increased or decreased as desired to vary the spacing of the plates. Since a light beam passes between these plates, the width of the associated light beam may thereby be adjusted. A pair of machine screws 136 extend through aligned openings in the plates and shims, hex nuts 138 being threaded on the threaded shanks of the machine screws to retain the plates in operative position.

An angle member 142 is secured to mounting plate 80 by a pair of machine screws 144 extending through aligned holes formed in the angle member and the mounting plate, hex nuts 146 being threaded on the threaded shanks of the screws to hold the angle member in place. A pair of spaced steel plates 150 and 152 have a pair of of narrow shims 154 disposed therebetween along the facing vertical edges thereof. The size or number of shims may be increased or decreased to adjust the width of a light beam passing between plates 150 and 152. A pair of machine screws 156 extend through aligned openings in the plates and shims, hex nuts 158 being threaded on the threaded shanks of the machine screws to retain the plates in operative position.

It is noted that the height of the spaced plates which create the narrow light beams as well as the spacing between the plates will establish the amount of head movement permitted by the device before the golfer loses sight of one or both of the beams. Accordingly, the height of the plates may also be varied to adjust the device to permit different amounts of head movement.

The light source for the device is supported on mounting plate 80, the support means including four steel round head machine screws 160 each of which extends through a surrounding steel tube 162 and thence through suitable holes provided through an upper container plate 164, this plate having a central circular hole 166 formed therein through which light is adapted to pass upwardly and pass through the spaces between the plates to produce the narrow light beams. Screws 160 extend downwardly and pass through suitable holes formed in a lower container plate 170, hex nuts 172 being threaded on the lower ends of the screws to hold the container plates in position.

A tubular container member 174 preferably formed of plastic is clamped between plates 164 and 170, the upper edge of member 174 resting against the under surface of plate 164 and defining an inner wall 176 having an inner diameter corresponding to the diameter of the hole 166 formed in plate 164. The lower edge of member 174 is seated within an annular groove formed in the upper surface of lower container plate 170.

Components of a conventional flashlight are employed as the light source to minimize cost. A radially inwardly extending shoulder 180 is formed on container member 174, and a flashlight lens 182 rests against this shoulder. A flashlight reflector 184 bears against lens 182 and engages a fitting 186 supported on a bulb holder 188 preferably formed of plastic. A flashlight bulb 190 is mounted within the bulb holder and includes a conductor portion 192 which is electrically connected to the conductive fitting 186. The bulb is also electrically connected to a copper insert 194 mounted on the bulb holder. The position of the light bulb, reflector and lens in a fixed position adjacent to the two slots provides the greatest light intensity directed to both of the slots.

A generally cup-shaped spring container 200 is mounted within a central circular opening formed in lower container plate 170 and has a coil compression spring 202 mounted therein. The upper end of the spring bears against a disc 204 preferably formed of plastic which has a steel contact 206 supported on the upper surface thereof. A first insulated copper wire 210 is electrically connected to contact 206, and a second insulated copper wire 212 is electrically connected to conductive fitting 186.

A flashlight case 220 is connected to the mounting plate 80 by a pair of U-bolts 222 and 224 which extend through suitable holes provided in the mounting plate, hex nuts 226 and 228 being threaded onto the threaded ends of the U-bolts to retain the flashlight case securely in position. Case 220 has the usual sliding switch 230 mounted thereon, and mounting plate 80 has a slot 232 formed therethrough to gain access to the switch so that the light source can be selectively turned on and off when desired. The cover of the outer housing will of course also be opened when it is desired to actuate the switch.

The usual "D" batteries 236 and 238 are disposed within the hollow interior of case 220 and are urged toward the aforedescribed light bulb by a compression spring 240. A stationary electrical conductor 242 is provided within the case and is in electrical contact with battery 236. A sliding electrical conductor 244 is movable with the switch and remains in electrical contact with conductor 242 at all times.

An end cap 250 is threaded on the end of the flashlight case and clamps a support member 252 preferably formed of plastic between the end cap and an end of the case. Support member 252 supports an annular steel contact ring 254 and a centrally located steel contact member 256. Contact ring 254 is electrically connected with wire 212 and contact member 256 is electrically connected at one end thereof with battery 238 and at the other end thereof with wire 210. It is apparent that when the slide switch 230 is moved toward the light bulb, the end 244' of sliding conductor 244 will come into contact with contact ring 254 thereby completing the electrical circuit through the light bulb and cause the light bulb to be illuminated.

When using the device of the present invention, the light generating means will first be energized. A golfer will then take his stance and adjust the position of the tee so that the golf ball is supported in the proper position. The mounting plate is then adjusted by rotating it to the desired position and then locked in position by the wing nut. In a typical example, the angle of the mounting plate to horizontal may be about sixty-nine degrees for a golfer who is five feet ten inches tall. The angle will be less for shorter golfers and greater for taller golfers. The limits of rotational movement are shown in phantom lines in FIGS. 2 and 8.

The width of the slots can then be adjusted by adding or subtracting shims between the plates in accordance with the skill of the golfer. He may need a fairly wide beam of light allowing considerable head movement as he learns how to use the device. As his skill improves, the widths of the slots can be reduced until an optimum beam width is reached which allows the amount of head motion that consistently yields the best results from the golf swing.

Figures 10, 11, 12:
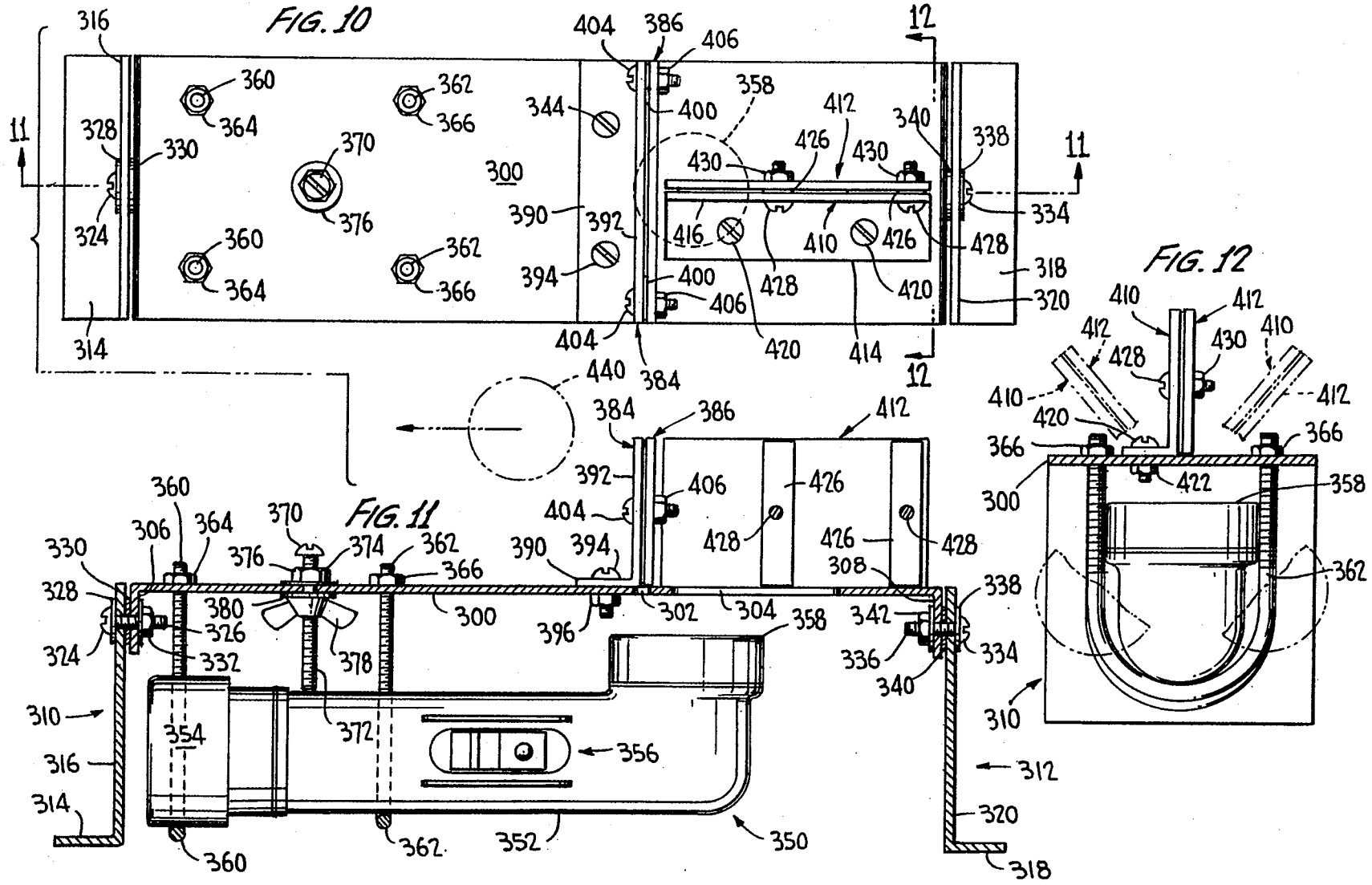
FIG. 10 is a top view of a second form of the invention.
FIG. 11 is a sectional view taken along line 11—11 of FIG. 10.
FIG. 12 is a sectional view taken along line 12—12 of FIG. 10.

Referring now to FIGS. 10–12, a second form of the invention is illustrated a generally flat mounting plate 300 formed of aluminum has a transversely extending slot 302 formed therethrough and a longitudinally extending slot 304 formed therethrough. Light is adapted to pass upwardly through these slots from a light source beneath the mounting plate. Opposite ends of plate 300 are provided with depending portions 306 and 308 for rotatably supporting the plate between a pair of support members 310 and 312 which are also formed of aluminum. Leg 310 includes a horizontal foot portion 314, the lower surface of which is adapted to be supported on the ground, and an integral vertical leg portion 316. Leg 312 includes a horizontal foot portion 318, the lower surface of which is adapted to be supported on the ground, and an integral vertical leg portion 320.

A round head steel machine screw 324 includes a threaded shank portion 326 which extends freely through aligned holes formed in depending portion 306 of the mounting plate and vertical leg portion 316 of the support member. A first steel washer 328 is disposed between the head of screw 324 and one surface of leg portion 316, and a second steel washer 330 is disposed between the opposite surface of leg portion 316 and depending portion 306. A steel hex elastic locknut 332 is threaded onto the shank portion 326 of the screw and is tightened to a degree that sufficient friction is provided between the components to permit rotation of support plate 300 relative to the support members, but which assures that the plate remains in adjusted position.

At the opposite end of support plate 300, a round head steel machine screw 334 includes a threaded shank portion 336 which extends freely through aligned holes formed in depending portion 308 of the mounting plate and vertical leg portion 320 of the support member. A first steel washer 338 is disposed between the head of screw 334 and one surface of leg portion 316, and a second steel washer 340 is disposed between the opposite surface of leg portion 320 and depending portion 308. A steel hex elastic locknut 342 is threaded onto the shank portion 336 and is tightened to a similar degree as the locknut 332.

A conventional right angle flashlight indicated generally by reference numeral 350 is commercially available from Fulton Industries, Inc., Wauseon, Ohio as Part No. N47-IB. This flashlight is weatherproof and therefore especially useful in the invention device. The flashlight includes a casing 352 having a removable cap 354 at one end thereof for replacing two conventional D size batteries within the casing. A conventional manually operated switch 356 is disposed on the outer surface of the casing, and light is emitted from the end portion 358 of the flashlight in an upward direction so as to pass through the slots 302 and 304 in mounting plate 300.

The flashlight casing is supported on support plate 300 by a pair of stainless steel U-bolts 360 and 362 which extend through suitable holes provided in mounting plate 300. Steel hex nuts 364 and 366 are threaded onto the threaded ends of the U-bolts. The flashlight casing is securely retained in the supported position by a steel round head machine screw 370 having a threaded shank 372 the lower end of which engages the outer surface of the casing. Shank 372 extends freely through a hole formed in the mounting plate and has a steel hex nut 374 threaded thereon which engages a steel washer 376 disposed about shank 372. A steel wing nut 378 is threaded on shank 372 and engages a steel washer 380 disposed about shank 372. With this construction, the lower end of screw 370 can be pressed firmly against the outer surface of the flashlight casing by tightening the wing nut, and the assembly can then be locked in position by a hex nut 374 which is threaded on shank 372 and engages a washer 376. It is apparent that the flashlight can be readily removed and then remounted in position when desired.

A pair of plates 384 and 386 formed of aluminum are operatively associated with slot 302 formed in the mounting plate. Plate 384 includes a horizontal portion 390 and an integral vertical portion 392. The horizontal portion 390 is secured to the mounting plate by a pair of steel round head machine screws 394 which extend through aligned holes formed in portion 390 and the mounting plate. Steel hex nuts 396 are threaded on the threaded shanks of screws 394 to hold plate 384 in place.

Plate 386 is flat and is spaced from portion 392 of plate 384 by a pair of narrow shims 400 disposed therebetween adjacent the facing vertical edges thereof. The size or number of shims may be increased or decreased to vary the spacing of the plates. A pair of steel round head machine screws 404 extend through aligned openings in the plates and shims, steel hex nuts 406 being threaded on the threaded shanks of the machine screws to retain plate 386 in position relative to plate 384.

A further pair of plates 410 and 412 formed of aluminum are operatively associated with slot 304 formed in the mounting plate. Plate 410 includes a horizontal portion 414 and an integral vertical portion 416. The horizontal portion 404 is secured to the mounting plate by a pair of steel round head machine screws 420 which extend through aligned holes formed in portion 414 and the mounting plate. Steel hex nuts 422 are threaded on the threaded shanks of screws 420 to hold plate 410 in place.

Plate 412 is flat and is spaced from portion 416 by a pair of narrow shims 426 disposed therebetween in locations clearly seen in FIG. 11. Here again, the size or number of shims may be increased or decreased to vary the spacing of the plates. A pair of steel round head machine screws 428 extend through aligned openings in the plates and shims, steel hex nuts 430 being threaded on the threaded shanks of the machine screws to retain plate 412 in position relative to plate 410.

In order to minimize the reflection of the light beams issuing from between the two pairs of plates and therefore minimizing glare to the golfer's eyes, the facing surfaces of each pair of plates as well as the upper or top surfaces of each pair of plates are provided with a coating of a substance such as automotive acrylic enamel with a large amount of acrylic lacquer flattener mixed therein to reduce reflection and glare.

In the second form of the invention, the device is placed on the ground in an area where a golfer wishes to hit some practice shots with the device being supported in position by the support members 310 and 312 as seen in FIG. 11. The light generating means is energized by operating switch 356 of the flashlight. The golfer then places a golf ball at one side of the device, and in a typical example, a golf ball may be placed on the ground or teed up about two inches from the device in a position as shown in phantom line 440 in FIG. 10. The distance of the ball from the device depends on the peripheral vision of the golfer, and in most cases the ball will be fairly close to the device so that the two narrow beams of light will be visible in the golfer's peripheral vision.

The beam of light passing between plates 384 and 386 is shown as being disposed rearwardly of the position of the golf ball relative to the intended line of flight as indicated by the arrow in FIG. 10. However, in this form of the invention, the ball can be positioned so that this beam of light is not actually rearward of the position of the ball, depending on the stance of the golfer and the type of club he is using. For example, when practicing with a wedge golf club, he may wish to move the ball far back in his stance, so as to move the ball to a position rearward of the light beam. The support plate 300 can be turned about the axis of screws 324 and 334 through a wide angle in either direction so as to move the plates and flashlight into the positions schematically shown in phantom lines in FIG. 12. Otherwise, the operation and advantages of this form of the invention are the same as discussed in connection with the first form of the invention.

The invention has been described with reference to a preferred embodiment. Obviously, modifications, alterations and other embodiments will occur to others upon reading and understanding this specification. It is my intention to include all such modifications, alterations and alternate embodiments insofar as they come within the scope of the appended claims or the equivalent thereof.

What is claimed is:

1. A golfer's head movement monitor device comprising, light beam generating means for generating two separate narrow beams of light in the general area of a golf ball so that when the golfer has taken his stance to hit the golf ball forwardly in a given direction and his eyes are focused on the golf ball, the beams of light will be seen in his peripheral vision, said light beam generating means including a first pair of spaced plates for generating one of said light beams and a second pair of spaced plates for generating a second one of said light beams, said light beams being disposed at an angle to one another, and means for adjusting the space between each pair of spaced plates to adjust the width of the light beam generated between each pair of plates.

2. A device as defined in claim 1 wherein said first pair of plates extends substantially perpendicular to said given direction to produce a light beam extending substantially perpendicular to said given direction.

3. A device as defined in claim 1 wherein said second pair of plates extends substantially parallel with said given direction to produce a light beam extending substantially parallel with said given direction.

4. A device as defined in claim 1 wherein said first pair of plates extends substantially perpendicular to said given direction to produce a light beam extending substantially perpendicular to said given direction, said second pair of plates being disposed rearwardly of said first pair of plates and extending substantially parallel with said given direction to produce a light beam extending substantially parallel with said given direction.

5. A device as defined in claim 1 including means on said plates for minimizing reflection of said light beams from said plates as the light beams pass between the associated plates thereby minimizing glare to the golfer's eyes.

6. A device as defined in claim 1 including mounting means for mounting said first and second pairs of plates, and means for rotating said mounting means about an axis generally parallel to said given direction to accommodate golfers of different height.

7. A device as defined in claim 6 wherein said light beam generating means includes a source of light disposed adjacent to and below said pairs of plates to shine upwardly through the spaces between the pairs of plates to produce said light beams shining in an upward direction.

8. A device as defined in claim 7 wherein said mounting means comprises a generally flat mounting member, said pairs of plates being mounted on one side of the mounting member, and said source of light being mounted on the other side of said mounting member.

9. A method of eliminating excessive head movement when swinging a golf club at a golf ball comprising the steps of locating in the vicinity of a golf ball being addressed by a golfer means for generating and projecting upward two separate narrow beams of light, angularly oriented relative each other, which may be seen in said golfer's peripheral vision while addressing said golf ball, and adjusting the positions of said beams of light relative said golfer so that one of said light beams extends laterally of the intended ball flight direction and the other of said light beams extends generally parallel to said intended ball flight direction, so that said golfer will know that excessive head movement has occurred and the direction thereof by losing sight of either or both said light beams while swinging a golf club and attempting to propel a golf ball along a predetermined ball flight direction.

* * * * *